US006708375B1

(12) United States Patent
Johnson

(10) Patent No.: US 6,708,375 B1
(45) Date of Patent: Mar. 23, 2004

(54) HARNESS WALLET

(76) Inventor: Maria Ward Johnson, 3 Lynwood Avenue, Toronto, Ontario (CA), M4V 1K3

( * ) Notice: Subject to any disclaimer, the term of this patent is extended or adjusted under 35 U.S.C. 154(b) by 0 days.

(21) Appl. No.: 10/370,511

(22) Filed: Feb. 24, 2003

(51) Int. Cl.[7] ..... A44B 21/00; A45F 5/02; B65D 63/02

(52) U.S. Cl. ..... 24/17 A; 24/17 B; 24/3.6; 24/3.12; 24/300

(58) Field of Search ..... 24/17 A, 17 B, 24/3.12, 545, 563, 336, 67.9, 300, 3.6

(56) References Cited

U.S. PATENT DOCUMENTS

| | | | | | |
|---|---|---|---|---|---|
| 556,383 | A | | 3/1896 | Teeter | |
| 675,318 | A | * | 5/1901 | Boothe | 24/17 A |
| 738,462 | A | * | 9/1903 | Lincoln | 24/17 B |
| 909,399 | A | * | 1/1909 | Greenwood | 24/17 A |
| 929,952 | A | * | 8/1909 | Johnson | 24/17 A |
| 1,006,584 | A | | 10/1911 | Millsaps | |
| 1,135,853 | A | * | 4/1915 | Seach | 24/17 A |
| 1,368,156 | A | * | 2/1921 | Jackson | 24/3.6 |
| 1,397,016 | A | * | 11/1921 | Post | 24/17 A |
| 1,617,556 | A | * | 2/1927 | Vineberg | 24/17 A |
| 1,718,433 | A | * | 6/1929 | Rivas | 24/3.6 |
| 4,569,108 | A | * | 2/1986 | Schwab | 24/300 |
| 5,279,019 | A | | 1/1994 | Knickle | |
| 5,459,905 | A | | 10/1995 | Voyre | |
| 5,533,656 | A | * | 7/1996 | Bonaldi | 224/667 |
| 5,881,436 | A | * | 3/1999 | Lyons | 24/17 A |
| 2002/0194711 | A1 | | 12/2002 | Stampler | |

* cited by examiner

*Primary Examiner*—Victor Sakran
(74) *Attorney, Agent, or Firm*—Anissimoff & Associates; Hans Koenig

(57) ABSTRACT

Disclosed is a wallet in the form of a harness with an attached key ring for carry credit cards and folded paper, such as paper currency, together with keys. The harness comprises two loops of elasticized material attached to each other at opposing points such that one loop encircles the length of the credit cards and the other loop encircles the width of the credit cards. The loops may comprise a buckle and may be adjustable to accommodate more cards. The key ring may be used to facilitate opening and closing of the harness.

10 Claims, 2 Drawing Sheets

HARNESS WALLET

FIELD OF THE INVENTION

The present invention relates to a wallet device for carrying cards, folded papers and the like together with keys.

BACKGROUND OF THE INVENTION

The use of credit cards and other cards of similar size, such as bank cards, membership cards, identity cards and medical cards has been steadily increasing. Users of such cards have the problem of carrying the cards in an efficient manner without the bulkiness of traditional wallets, while simultaneously carrying other items such as paper money, notes, receipts and keys. A single, compact and inexpensive device for carrying all of these items simultaneously would be convenient and beneficial, especially for more active people who frequently need simpler, yet more efficient devices to carry such items when they jog, hike or participate in other recreational activities.

A binder device for receiving and holding packages of letters is disclosed in U.S. Pat. No. 1,006,584 issued on Oct. 24, 1911 to Millsaps. Four elastic straps are connected at two points by pins to permit pivoting of the straps on the pins.

U.S. Pat. No. 556,383 discloses a letter holder in which four coiled springs are attached to two metal plates to form a holder in which the letters may be carried.

There remains a need for a simple, multifunctional device for holding a variety of common items, including cards, papers and keys.

SUMMARY OF THE INVENTION

There is provided a pocket-sized wallet comprising: a first loop comprising elastic material attached to a second loop comprising elastic material at two opposing points on the loops to form a volume bounded by the first loop and the second loop to form a harness for carrying cards and/or folded paper in which a first pair of opposed edges of the cards and/or folded paper is contacted by the first loop and a second pair of opposed edges of the cards and/or folded paper is contacted by the second loop; and, a key ring attached to one of the loops.

There is also provided a pocket-sized wallet comprising: a first loop comprising elastic material attached to a second loop comprising elastic material at two opposing points on the loops to form a volume bounded by the first loop and the second loop to form a harness for carrying cards and/or folded paper in which a first pair of opposed edges of the cards and/or folded paper is contacted by the first loop and a second pair of opposed edges of the cards and/or folded paper is contacted by the second loop; a key ring attached to one of the loops; and, a buckle which forms part of one or more of the loops.

The wallet of the present invention is excellent for carrying a variety of items, for example, cards (e.g. credit cards, bank cards, membership cards, identification cards, medical cards, etc.) and/or folded paper (e.g. paper money, notes, receipts, etc.) and keys. It is simple, efficient, small in size and inexpensive to manufacture.

The wallet of the present invention comprises at least two loops of material attached at opposing points to form a harness for carrying cards and/or folded paper. In this manner, one loop encircles a width of the cards and/or folded paper and another loop encircles a length of the cards or folded paper. Two loops are arranged to intersect at two opposing points, and the loops attached to each other at the points of intersection. The loops may be attached at the opposing points by any convenient means, for example, by stitches, rivets, pins, glue, and the like. In one embodiment, a buckle may serve as a point of attachment for two loops, the buckle forming part of each of the loops.

The loops may be made of any suitable material, although it is preferred that the loops comprise, at least in part, an elastic material to facilitate removal and insertion of cards and paper into the harness. For example, cloth material having elastic strips sewn therein to form an elasticized cloth strap is one suitable material useful in loops of the present invention. Each loop may be formed of a single strap plus any buckles that may be present. Alternatively, each loop may be formed from several straps connected end-to-end, the connection being effected by any convenient means, such as, for example, by stitches, rivets, pins, glue, and the like.

While the loops may intersect at any suitable angle to form a harness for carrying cards and/or folded paper, preferably there are two loops that form a substantially ninety degree angle at their points of intersection so that the loops are orthogonal to one another.

In one embodiment of the invention, one loop of material may be shorter than another loop of material to accommodate the difference between the length and width of the cards being carried in the harness. In addition, loops of material may intersect to form a substantially cross-shaped outline when viewed in two-dimensional top view, or, the loops may intersect to form a substantially T-shaped outline when viewed in two-dimensional top view. Thus, the distance from one opposing point to the other along one arc of a loop may or may not be the same as the distance along the other arc of the same loop.

The wallet may further comprise a buckle. Any suitable type of buckle may be used, for example, slide-lock arrangements, pin and hole arrangements, clasp arrangements, etc. Any number of buckles may be used. For example, two loops may comprise a buckle to permit unbuckling and/or adjustment in two dimensions. The buckle may be integrated into one or more of the loops to form a part of the loops. Buckling and unbuckling the buckle permits opening a loop for easy insertion and removal of cards and/or folded paper into the wallet. In one embodiment, the buckle forms a part of two loops and forms one of the opposing points at which the loops are attached. In another embodiment, there may be a buckle at each of the opposing points at which the loops are attached. In yet another embodiment, the buckle may form part of only one loop. In the latter embodiment, it is sometimes advantageous to attach the key ring to the same loop as the buckle.

Furthermore, the wallet may comprise means for changing the length of one or more of the loops to accommodate more or less cards and/or folded papers. Any suitable means for changing the length may be employed. For example, one or more of the loops may comprise a secondary loop of material formed by pinching the loop and adjustably securing the loop at the point of pinching using any suitable means, such as, for example, a clip. By adjusting the size of the secondary loop, the length of the loop may be adjusted in kind. In another example, a loop may be adjustably engaged within a buckle so that the loop includes the buckle, and, an extra length of the loop is available for enlarging or shrinking the loop by adjusting the position of the buckle on the loop. In the latter example, a strap of material with a buckle on an end of the strap forms a loop with a "tail" when another end of the strap is fed through the buckle. Thus, the strap has a length greater than the length required for the loop, and adjustment of the strap in the buckle can change the length of the loop.

The key ring may be attached to any of the loops of the wallet. The wallet may comprise more than one key ring. A standard key ring having adjacent concentric rings formed from a single length of material, for example plastic or metal, may be used. Any suitable means for attaching the key ring to the loop may be employed. In one embodiment, the key ring may be attached to the loop by pinching the material of the loop between concentric circles of the key ring's rings. Further stitching or riveting of the loop's material at the point of attachment of the key ring helps secure the key ring to the loop. Alternatively, the loop may be threaded through the key ring rather than pinched between the concentric rings and the key ring secured by stitching or riveting the loop material together at the desired point of attachment of the key ring to the loop.

Not only is the key ring unitized with the wallet structure as a whole for convenience of carrying, but it also acts as a handle and a lever to aid in inserting and removing cards and/or folded paper from the harness. By grasping the key ring and slipping the loop to the side and/or pulling on the loop, it is possible to open up the harness to thereby facilitate removal and insertion of the cards and/or folded paper. Thus, the key ring works in unison with the harness to facilitate operation of the wallet. The lever action of the key ring provides an important benefit with respect to the ease and convenience of using the wallet. The key ring is advantageously attached to a loop at a point on the loop about midway between the two opposing points. When the harness is T-shaped in a two-dimensional top view, the key ring is preferably attached to the longer loop at about the midway point of the longer arc (i.e. at the end of the stem of the T). This allows greater leverage when slipping the loop to the side permitting greater access to the cards and/or folded paper. The ratio of the length of the longer arc to the shorter arc may be any suitable value, for example, about 3:2.

The key ring may also be used to connect the harness to a band worn around a person's wrist. The band may be adapted to easily connect to the key ring. Such an arrangement would further facilitate efficient carrying of items, particularly for people who are jogging, hiking or participating in other recreational activities.

One or more of the loops may comprise printed matter, such as, for example, advertising, identification and/or ornamentation and/or design.

BRIEF DESCRIPTION OF THE DRAWINGS

In order that the invention may be more clearly understood, preferred embodiments thereof will now be described in detail by way of example, with reference to the accompanying drawings, in which.

DESCRIPTION OF PREFERRED EMBODIMENTS

Figure 1:
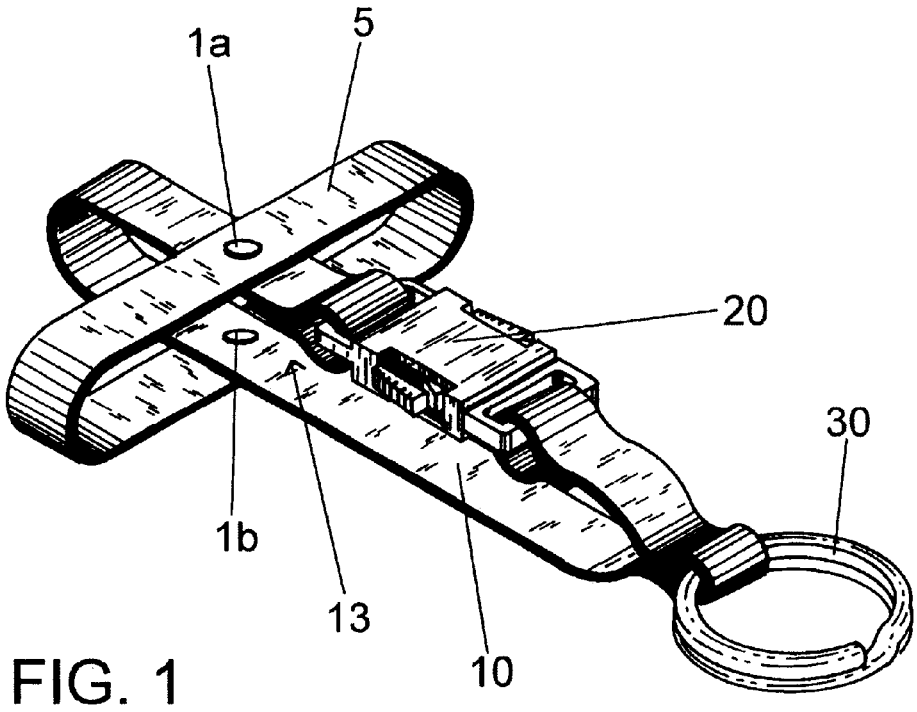
FIG. 1 is a perspective view of an embodiment of a wallet of the present invention.

FIG. 1 is a perspective view of an embodiment of a wallet of the present invention. A first loop (5) of elasticized cloth material is attached to a second loop (10) of elasticized cloth material at two opposing points by rivets **(1*a*,1*b*) to form a harness with a volume, generally indicated as (13), within which cards and/or folded paper (not shown) can be carried. The first loop (5) is shorter than the second loop (10) to more readily accommodate the width of the cards and/or folded paper while the second loop (10) has a length that more readily accommodates the length of the cards and/or folded paper. The loops are orthogonal to each other. The rivets (1*a*,1*b*) at opposing points attach the first loop (5) to the second loop (10) such that each loop is divided into two arcs each, each arc starting at one opposing point and ending at the other opposing point. In relation to the first loop (5), the two arcs are substantially the same length. In relation to the second loop (10), one of the arcs is longer than the other, thus the first loop (5) is attached off-center on the second loop (10). A slide buckle (20) is part of the second loop (10) and is located in the longer of the two arcs of the second loop (10). The slide buckle (20) can be opened and closed to assist in removal and insertion of cards and/or folded paper. A key ring (30) is attached to the second loop (10) at a point about midway between the opposing points on the longer arc, that is, on the same arc as the buckle (20)**.

Figure 2:
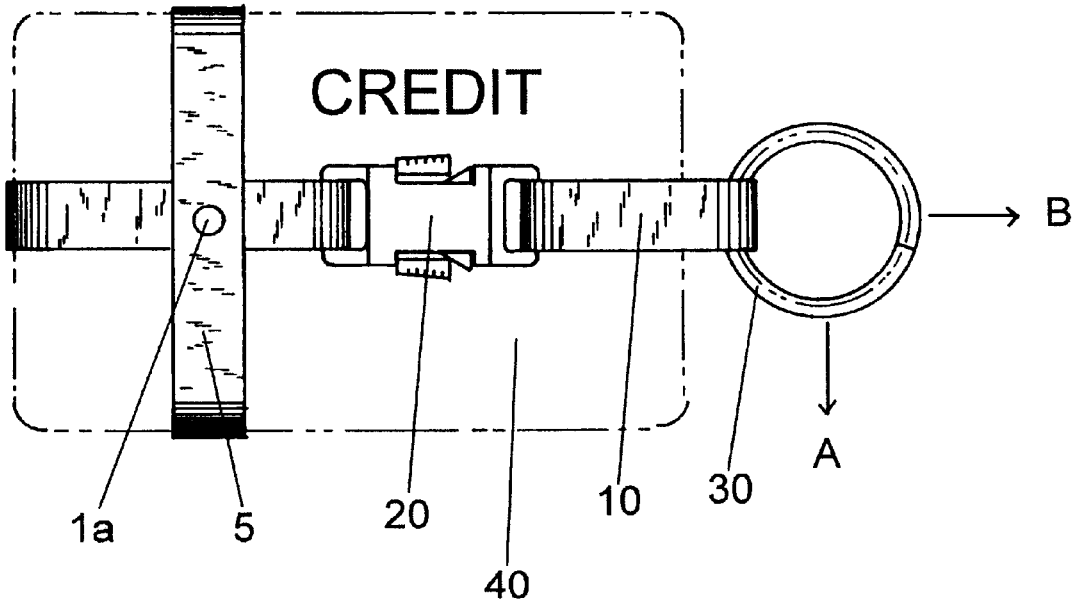
FIG. 2 is a top plan view of the wallet of FIG. 1 having a credit card therein.

Referring to FIG. 2, the wallet of FIG. 1 is shown in top view in a two-dimensional rendering. Additionally, a credit card (40) carried within the harness is shown in dashed lines. It can be seen from FIG. 2 that the first loop (5) and the second loop (10) form a "T" at rivet **(1*a*). The other rivet is not seen as it is directly under rivet (1*a*), but the two loops also form a "T" at the other rivet. The buckle (20) is located in the long stem of the "T" and the key ring (30) is attached to the end of the long stem of the "T". The first loop (5) contacts one pair of opposed edges (the long edges) of the card (40) while the second loop (10) contacts the other pair of opposed edges (the short edges) of the card (40) to hold the card in place. Not only does the key ring (30) hold keys, but it also facilitates removal and insertion of cards and/or folded paper into the harness. By grasping the key ring (30) and sliding it in the direction labeled by arrow (A) and/or pulling it in the direction labeled by arrow (B), the harness may be opened up to facilitate the insertion and removal of the cards and folded paper from the harness. The rivets (only (1*a*) being shown), advantageously act as pivot points for the motion of the second loop (10) when the key ring (30) is slid in direction (A), additionally facilitating opening up of the harness. When the key ring (30) is slid in direction (A), contact of the second loop (10) with one edge of the card (40) is relieved and the card (40)** is free to be removed from the harness and/or another card inserted into the harness.

Figure 3:
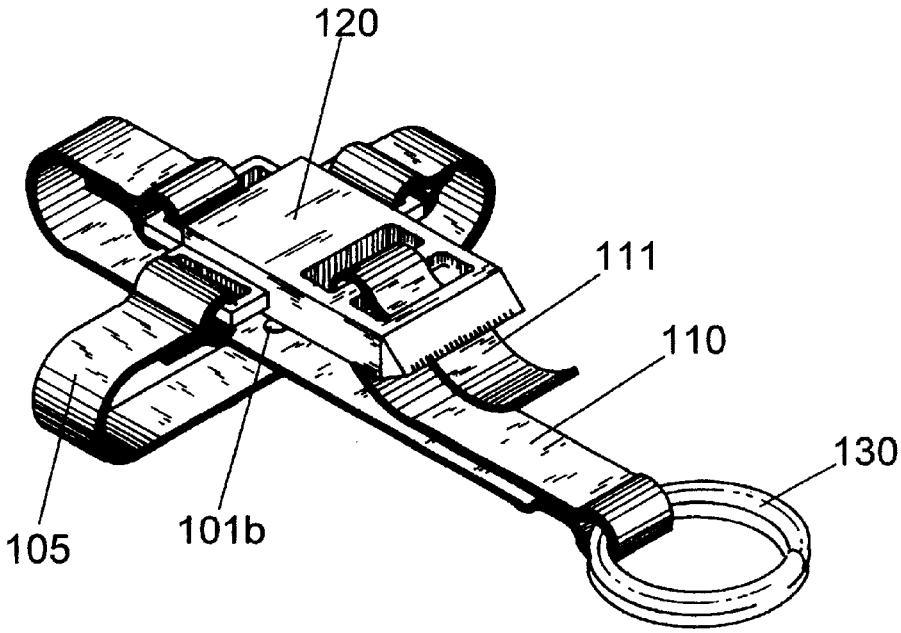
FIG. 3 is a perspective view of another embodiment of a wallet of the present invention; and, FIG. 4 is a top plan view of the wallet of FIG. 3 having a credit card therein.

FIG. 3 is a perspective view of another embodiment of a wallet of the present invention. In this embodiment, a buckle (120) in second loop (110) also acts as an attachment means for both the second loop (110) and first loop (105) at one opposing point. A rivet **(101*b*) serves to attach the first loop (105) to the second loop (110) at another opposing point. As described above, the arcs formed between the opposing points are the same length in the first loop (105) but are unequal in the second loop (110). The loops (105,110) are made from elasticized cloth straps and the second loop (110) is formed from a strap longer than is required to form the second loop (110). Thus, the strap forming the second loop (110) may be adjustably engaged with the buckle (120) to accommodate more or fewer cards and/or folded papers. An extra length of strap (111) is available for enlarging or shrinking the second loop (110) by adjustment of the second loop (110) in the buckle (120). A key ring (130) is attached to the second loop (110) at about the midway point of the longer arc. The key ring (130)** functions in a similar manner as described above.

Figure 4:
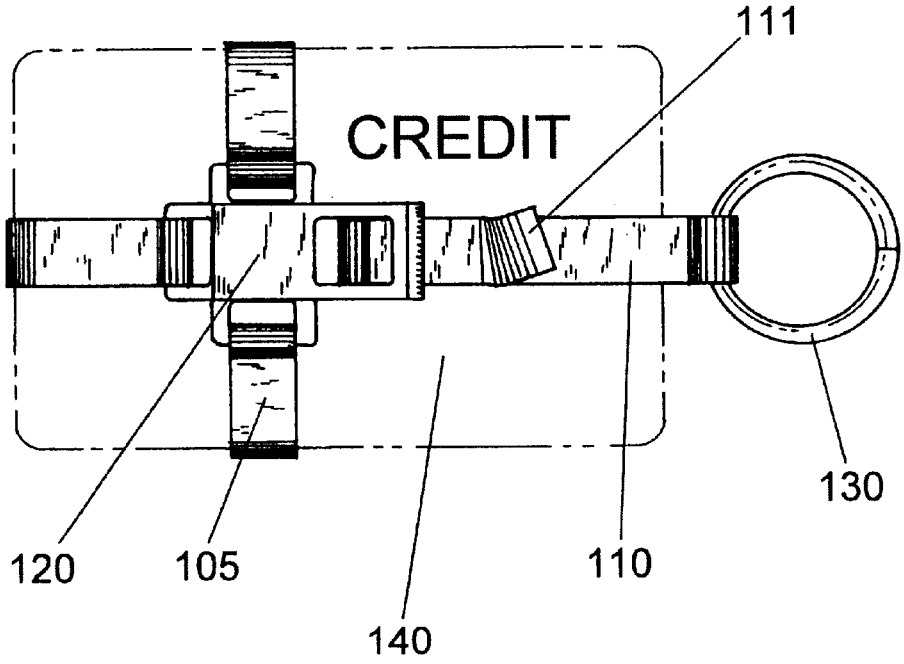

Referring to FIG. 4, the wallet of FIG. 3 is shown in top view in a two-dimensional rendering. Additionally, a credit card (140) carried within the harness is shown in dashed lines. It can be seen from FIG. 4 that the first loop (105) and the second loop (110) form a "T" at buckle (120). The rivet at the other opposing point is not seen as it is directly under buckle (120), but the two loops (105,110) also form a "T" at the rivet. Key ring (130) is attached to the second loop (110) at the end of the long stem of the "T". The first loop (105) contacts one pair of opposed edges (the long edges) of the card (140) while the second loop (110) contacts the other pair of opposed edges (the short edges) of the card (140) to hold the card in place. The key ring (130) functions in a similar manner as described above in FIG. 2. The rivet (not shown), advantageously acts as pivot point for the motion of the second loop (110) when the key ring (130) is slid and/or pulled to open up the harness, additionally facilitating opening up of the harness. The second loop (110) is made from a strap longer than is required to complete loop, thus an extra length of strap (111) is available for enlarging or shrinking the second loop (110) by adjustment of the second loop (110) in the buckle (120).

Other advantages which are inherent to the structure will be evident to one skilled in the art.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having described the invention, what is claimed is:

1. A pocket-sized wallet comprising:

(a) a first loop comprising elastic material attached to a second loop comprising elastic material at two opposing points on the loops to form a volume bounded by the first loop and the second loop to form a harness for carrying cards and/or folded paper in which a first pair of opposed edges of the cards and/or folded paper is contacted by the first loop and a second pair of opposed edges of the cards and/or folded paper is contacted by the second loop;

(b) a key ring attached to one of the loops for acting as a handle and a lever for facilitating insertion, removal or both insertion and removal of the cards and/or folded paper into and/or from the harness; and, (c) a buckle which forms part of one or more of the loops.

2. The wallet according to claim 1, wherein the buckle forms part of the first and second loops and the buckle forms one of the opposing points at which the first loop and the second loop are attached.

3. The wallet according to claim 1, wherein the buckle forms part of only one of the loops.

4. The wallet according to claim 3, wherein the key ring is attached to the loop that comprises the buckle.

5. The wallet according to claim 1, further comprising means for changing length of one or more of the loops.

6. The wallet according to claim 5, wherein the length is changed by adjusting position of the buckle on the loop.

7. The wallet according to claim 1, wherein the first loop is orthogonal to the second loop.

8. The wallet according to claim 7, wherein the harness is T-shaped.

9. The wallet according to claim 1, wherein the key ring is attached to a loop at a point about midway between the two opposing points.

10. The wallet according to claim 1, wherein there are two buckles and the buckles are at the two opposing points on the loops at which the first loop is attached to the second loop.

* * * * *